US005869436A

United States Patent [19]

Lindman

[11] Patent Number: 5,869,436

[45] Date of Patent: Feb. 9, 1999

[54] NON-TOXIC ANTIMICROBIAL LUBRICANT

[75] Inventor: Jerry Lindman, Scottsdale, Ariz.

[73] Assignee: American Eagle Technologies, Inc., Missoula, Mont.

[21] Appl. No.: 897,133

[22] Filed: Jul. 18, 1997

Related U.S. Application Data

[63] Continuation of Ser. No. 730,355, Oct. 15, 1996, abandoned.

[51] Int. Cl.[6] ..... C10M 125/18; C10M 137/04

[52] U.S. Cl. ..... 508/174; 508/244; 508/261; 508/421; 508/514; 508/530; 508/547; 508/584

[58] Field of Search ..... 508/421, 174, 508/244, 261, 513, 514, 550, 547, 584; 433/104

[56] References Cited

U.S. PATENT DOCUMENTS

| | | | |
|---|---|---|---|
| 3,215,630 | 11/1965 | Compton et al. | 508/154 |
| 3,282,777 | 11/1966 | Ceriotti | 508/154 |
| 4,149,983 | 4/1979 | Grier et al. | 508/257 |
| 4,212,750 | 7/1980 | Gorman | 508/279 |
| 4,265,899 | 5/1981 | Lewis et al. | 424/270 |
| 4,584,116 | 4/1986 | Hermant et al. | 508/154 |
| 4,995,997 | 2/1991 | Noda et al. | 508/262 |
| 5,093,031 | 3/1992 | Login et al. | 252/357 |
| 5,131,845 | 7/1992 | Feldman et al. | 433/104 |
| 5,158,778 | 10/1992 | Donovan et al. | 424/488 |
| 5,179,127 | 1/1993 | Hau | 514/844 |
| 5,209,930 | 5/1993 | Bowers-Daines et al. | 424/401 |
| 5,244,589 | 9/1993 | Liu et al. | 252/34 |
| 5,244,653 | 9/1993 | Berke et al. | 424/70 |
| 5,283,005 | 2/1994 | Nelson, Jr. et al. . | |
| 5,284,844 | 2/1994 | Lorenz et al. | 514/8 |
| 5,292,762 | 3/1994 | Hsu | 514/363 |
| 5,326,492 | 7/1994 | Hodam, Jr. . | |
| 5,332,516 | 7/1994 | Stephens . | |
| 5,348,678 | 9/1994 | Hodam, Jr. et al. . | |
| 5,356,555 | 10/1994 | Huth et al. . | |
| 5,384,326 | 1/1995 | Gironda et al. | 514/372 |
| 5,391,561 | 2/1995 | Hsu | 514/364 |
| 5,416,210 | 5/1995 | Sherba et al. | 540/609 |
| 5,464,851 | 11/1995 | Morpheth | 208/19 |
| 5,512,191 | 4/1996 | Krueger . | |
| 5,520,882 | 5/1996 | Brown | 422/7 |

*Primary Examiner*—Jacqueline V. Howard
*Assistant Examiner*—Cephia D. Toomer
*Attorney, Agent, or Firm*—Dowrey & Associates

[57] ABSTRACT

A non-toxic antimicrobial-boundary lubricant comprises a major portion of mineral oil and a minor portion of an extreme pressure additive; an antioxidant; and an antimicrobial compound. The lubricant has a pH of about 7.4 and preferably contains chlorhexidine gluconate as an antimicrobial compound.

6 Claims, No Drawings

NON-TOXIC ANTIMICROBIAL LUBRICANT

This application is a continuation of application Ser. No. 08/730,355, filed Oct. 15, 1996, now abandoned.

BACKGROUND OF THE INVENTION

1. Field of the Invention

This invention relates to lubricants containing an antimicrobial compound.

2. Brief Description of the Prior Art

Lubricants containing an antimicrobial compound have been generally known. Commonly, such lubricants include an antimicrobial compound for one or more of a number of reasons, including preservation of the lubricant from deterioration or contamination, and protection of those coming in contact with the lubricant from a condition known as contact dermatitis. For these and similar reasons for the use of an antimicrobial compound, the antimicrobial compound must be active in the presence of the lubricant's substituents and strong enough to perform the function for which it is used. In the typical instances of preserving the lubricant or preventing contact dermatitis, the antimicrobial compounds heretofore proposed for use have been toxic to humans if ingested. Consequently, antimicrobial compound-containing lubricants have been limited to certain applications in which human ingestion is unlikely because they are too aggressive for human ingestion.

Moreover, certain applications for lubricants require the use of a special class of lubricants called boundary lubricants. Such applications often pose severe loading, high speed, or high temperature conditions that non-boundary lubricants cannot adequately tolerate. Consequently, extreme pressure additives have been developed that, when added to a base lubricant, produce a boundary lubricant for these severe applications. The presence of extreme pressure additives in lubricants is very important if a lubricant is to perform favorably under heavily loaded, high speed, or high temperature conditions. Typical of such an application are dental tools such as dental hand pieces, and some medical devices, where boundary lubrication is essential in cage/ball and cage/race bearing contacts. In the absence of a suitable boundary lubricant, such devices wear out much too soon because metal to metal contact creates unacceptable wear and surface distress.

Dental tools and some medical devices, in which use of a boundary lubricant would be highly desirable, come into contact with internal parts of the human body; dental tools with the oral cavity, of course. However, extreme pressure additives used in boundary lubricants are so highly toxic that they are unsuitable for use in devices that may come into contact with internal parts of the human body, such as the oral cavity in the case of dental tools. Furthermore, known antimicrobial compounds used in lubricants are also too aggressive for such uses.

SUMMARY OF THE INVENTION

It is a primary object of the present invention to provide a non-toxic boundary lubricant that contains a non-toxic antimicrobial compound so that devices employing such a lubricant can safely come into contact with internal parts of the human body, such as the oral cavity.

This and other objects and advantages will become apparent from the following description of the invention.

In accordance with these objects and advantages, the invention comprises:

DESCRIPTION OF THE PREFERRED EMBODIMENT

The lubricant of the present invention is a non-aqueous lubricant having a major part comprising a suitable petroleum-based oil base, such as mineral oil. U.S.P. Grade mineral oil (CAS 8012-95-1) is a suitable stock base lubricant product for use in the present invention. The lubricant has a minor part of an extreme pressure additive, such as a phosphate ester oil additive, the resulting boundary lubricant composition being a base fluid to which the herein below-identified substituents are added. Of this base fluid, the mineral oil component preferably constitutes between about 85% and 95% by volume, and the extreme pressure additive preferably constitutes between about 5% and 15% by volume.

As such, the boundary lubricant composition base fluid of the present invention fits within the overall class of lubricants known as fluid boundary lubricants, having capability of boundary film lubrication where a eutectic film is formed between metal surfaces under the extreme operating conditions to which the lubricated metal surfaces are exposed.

To the boundary lubricant base fluid, a suitable non-toxic antioxidant is added to de-toxify the extreme pressure additive. A suitable antioxidant emulsifier would be a biological antioxidant such as DL-alpha-Tocopherol, U.S.P./N.F. (CAS 59-02-9), of the vitamin E group. Only a very small amount of antioxidant is required, in the case of Dl-alpha-Tocopherol about 26.0 grams per 54.0 gallons of the base fluid.

The boundary lubricant and antioxidant are blended together with a suitable non-toxic emulsifier, such as polyoxypropylene 15 stearyl ether (CFTA name: PPG-15 Stearyl Ether). A suitable emulsifier is AMOL E Emollient-Solvent, available from ICI Surfactants, in an amount sufficient to completely emulsify the mixture. Other U.S.P./N.F. Grade emulsifying agents could be selected from the following group: Acacia (CAS 9000-01-5); 2-aminoethanol (CAS 141-43-5); cholesterol (CAS 57-88-5); octadecanoic acid (CAS 57-11-4); lecithin; 9-octadecanoic acid (CAS 112-80-1); polyethylene-polypropylene glycol (CAS 9003-11-6); polyoxyl 20 cetostearyl ester (CAS 9005-00-9); polyoxyl 40 stearyl (CAS 9004-99-3); polysorbate 20 (CAS 9005-64-5); polysorbate 40 (CAS 9005-66-7); polysorbate 60 (CAS 9005-67-8); polysorbate 80 (CAS 9005-65-8); sodium lauryl sulfate (CAS 151-21-3); j sodium stearate (CAS 822-162); sorbitan monooleate (CAS 1338-43-8); sorbitan monopalmitate (CAS 26266-57-9); sorbitan monostearate (CAS 1338-41-6); triethanolamine (CAS 102-71-6).

Following the blending of the antioxidant and emulsifier substitutents into the base fluid, the mixture is buffered so as to be physiologically neutral, pH 7.3–7.48. A suitable buffering agent is acetic acid, 36% (w/w), U.S.P./N.F. (CAS 64-19-7). Then, an appropriate non-toxic antimicrobial compound is added in an appropriate efficacious amount to produce the final mixture, between about 0.001% and 25.000% by volume of the final mixture. A suitable antimicrobial compound could be selected from the following group: chlorhexidine gluconate (CAS 18472-51-0); cetylpyridinium chloride (CAS 123-03-5); sanguinarine (CAS 2447-54-3); sodium fluoride (CAS 7681-49-4); thymol (CAS 89-83-8); equal parts of (a) alkyl dimethyl betaine (CAS 693-33-4) and (b) N,N-dimethyl alkylamine-N-oxide (CAS 3332-27-2). Of these antimicrobial compounds, chlorhexidine gluconate is preferred because of its 50 year safety record. The type and amount of the non-toxic antimicrobial compound to be added would depend on the variety of microorganisms to be controlled, such as fungus, bacteria, algae, viruses and yeast, but not necessarily limited to these varieties. The relative amounts of antimicrobial compounds to be added to the final mixture will depend on the application and the useful antimicrobial dosage range for a particular application. Typical such applications would include health care products, dental care products food processing systems, and any other of the like.

The blending of a preferred non-toxic antimicrobial boundary lubricant would be as follows;

1. Blending the base fluid. Stage one begins with a stock base lubricant of U.S.P. Grade mineral oil. To this base lubricant, an EP additive (commercially available phosphate ester oil additive) is blended until a mixture of between 85% and 95% by volume mineral oil with the phosphate ester part being between 5% and 15%.

2. Blending the second stage fluid. After stabilizing a 54.0 gallon quantity of base fluid at 32° C., 26.0 grams of DL-alpha-Tocopherol, preheated to 55° C. is added. The addition of this hydrophilic polymer is used to form the anti-corrosive element so useful for sterilizing, disinfecting and cleaning devices generally including medical and dental devices where the efficacy of cleaning and sterilizing requires severe treatment. Using a paddle mixer, the entire solution is mixed for 60 minutes. While continuing to mix the heated solution, a small amount such as 50 cc may be removed, being careful to observe sterile sampling techniques, and emulsified using the standard Hydrophile-Lipophile-Balance system technique using ARLAMOL E Emollient-Solvent preheated to 60° C. to establish the proportion of emulsifier required to balance the solution. During the balancing process, care should be taken to maintain both the second stage sample and the emulsifier at their respective temperatures of 55° C. and 60° C. and to accurately account for the volume of emulsifying agent required to achieve balance. Once the amount of emulsifier is known, a proportionate amount must be added to the bulk second stage fluid. While maintaining the 55° C. temperature, continue mixing with the paddle mixer for 90 minutes, whereupon this stage is complete. While not required, a biological microscope will assist the technician to balance the solution.

3. Blending the final stage fluid. Using ASTM test method D-2896 (88), (Standard Test Method for Base Number of Petroleum Products by Potentiometric Perchloric Acid Titration), adjust the solution using the acetic acid buffer to a pH range of 7.4–7.48. Depending on the desired end use of the product, the amount of the final stage product will vary from 75.000% to 99.999% by volume. The remainder volume will be a combination of emulsifier, added in stage 2, and the antimicrobial compound. The preferred antimicrobial composition, chlorhexidine gluconate may be used in an amount up to 25.0%, with 0.12% being preferred. The amount of emulsifier used in stage 2 may comprise up to 25% by volume of the final stage product.

The physical data of a commercial version of the final stage produce, containing 0.12% chlorhexidine gluconate are:

| | |
|---|---|
| Physical State | Liquid |
| Color/Odor | Clear-Pleasant, nutty odor |
| Specific Gravity | <1.0 @ 15° C. |
| Vapor pressure | <0.5 mm |
| Evaporation Rate | Nil @ 25° C. |
| Boiling Point | >230° C. |
| Freezing Point | <−60° C. |
| Flash Point | >176° C. (350° F.) |
| Sol. in Water | Nil |
| pH | 7.4 |
| Viscosity | 100 (SUS) |

Contrary to the general class of boundary lubricants, the boundary lubricant of this invention is non-toxic and suitable for human contact. The general class of boundary lubricants have, as one of their greatest drawbacks, the general toxic nature of their elementary components which are unsuitable for human contact and have borne the appropriate label warning, "Harmful or fatal if swallowed." The boundary lubricant of this invention is non-toxic and thus set apart from the general class of boundary lubricants.

While the preferred embodiment of the invention has been described herein, variations in the design may be made.

| PRODUCT | MAKER |
|---|---|
| 1. Champ Lube | Champion Dental Products |
| 2. Power-Point | Don Patch |
| 3. Micro Space | Precision Lubricants International |
| 4. Phase Change | Bud Wheeler |

The scope of the invention, therefore, is only to be limited by the claims appended hereto.

The embodiments of the invention in which an exclusive property is claimed are defined as follows:

I claim:

1. A non-toxic non-aqueous antimicrobial boundary lubricant for use in lubricating tools intended to come into contact with internal parts of the human body comprising a major portion of a U.S.P. Grade mineral oil and a minor portion of a phosphate ester oil extreme pressure additive, the mixture of mineral oil and extreme pressure additive having a composition of mineral oil between 85% and 95 % by volume and of extreme pressure additive between about 5% and 15 % by volume; a non-toxic antioxidant/emulsifier compound added to said mixture to detoxify and emulsify said mixture so as to form a non-toxic second stage mixture, said second stage mixture being suitable for use in tools that come into contact with internal parts of the human body; and an antimicrobial compound blended into said second stage mixture, said antimicrobial being suitable for use in tools that come into contact with internal parts of the human body and being selected from the group consisting of chlorhexidine gluconate (CAS-18472-51-0), cetylpyridinium chloride (CAS 123-03-5), sanguinarine (CAS 2447-54-3), sodium fluoride (CAS 7681-49-4), thymol (CAS 89-83-8) and a constituent composed of equal parts of (a) an alkyl dimethyl betaine and (b) N,N-dimethyl alkyl amine-N-oxide.

2. The lubricant of claim 1 wherein said mineral oil, extreme pressure additive and antioxidant substituents in said second stage mixture have been emulsified and neutralized to a pH range between 7.3 and 7.48 prior to addition of said antimicrobial.

3. The lubricant of claim 1 wherein said antioxidant is DL-alpha-Tocopherol (CAS 59-02-9).

4. The lubricant of claim 1 wherein said emulsifier includes PPG-15 Stearyl Ether.

5. The lubricant of claim 1 wherein said mineral oil, extreme pressure additive and antioxidant substituents have been emulsified and neutralized to a pH range between 7.3 and 7.48 prior to addition of said antimicrobial; and wherein said antioxidant is DL-alpha-Tocopherol (CAS 59-02-9).

6. The lubricant of claim 5 wherein said emulsifier includes PPG-15 Stearyl Ether.

* * * * *

UNITED STATES PATENT AND TRADEMARK OFFICE

CERTIFICATE OF CORRECTION

PATENT NO : 5,869,436

DATED : Feb. 9, 1999

INVENTOR(S) : Jerry Lindman

It is certified that error appears in the above-identified patent and that said Letters Patent is hereby corrected as shown below:

Column 4, immediately following line 11, insert the following paragraph:

--A less than optimum, but still acceptable final second stage could be acheived by not employing an emulsifier. The following products are of this nature, and could be employed in blending stage 3.--

Signed and Sealed this

Twentieth Day of March, 2001

Nicholas P. Godici

*Attest:*

NICHOLAS P. GODICI

*Attesting Officer*

*Acting Director of the United States Patent and Trademark Office*